US010550634B1

(12) United States Patent
Holland

(10) Patent No.: US 10,550,634 B1
(45) Date of Patent: Feb. 4, 2020

(54) CHILD SAFETY GATE SYSTEM

(71) Applicant: Matthew Holland, Bessemer, AL (US)

(72) Inventor: Matthew Holland, Bessemer, AL (US)

( * ) Notice: Subject to any disclaimer, the term of this patent is extended or adjusted under 35 U.S.C. 154(b) by 203 days.

(21) Appl. No.: 15/682,676

(22) Filed: Aug. 22, 2017

(51) Int. Cl.

| | |
|---|---|
| ***E06B 11/02*** | (2006.01) |
| ***E06B 9/06*** | (2006.01) |
| ***E04B 2/74*** | (2006.01) |
| ***E06B 9/80*** | (2006.01) |
| *E06B 9/00* | (2006.01) |
| *E04F 11/18* | (2006.01) |

(52) U.S. Cl.
CPC ..... *E06B 9/06* (2013.01); *E04B 2/7429* (2013.01); *E06B 9/80* (2013.01); *E04F 11/1861* (2013.01); *E06B 2009/002* (2013.01); *E06B 2009/801* (2013.01)

(58) Field of Classification Search
CPC . E06B 9/0692; E06B 9/02; E06B 9/04; E06B 2009/002; E06B 11/00; E06B 11/02; E04F 11/1861; E05B 65/0007
USPC ..... 160/351, 368.1; 49/54, 55, 56, 57; 256/73
See application file for complete search history.

(56) References Cited

U.S. PATENT DOCUMENTS 219,024 A * 8/1879 Sanborn ..... E05B 17/0025 49/395
1,175,109 A * 3/1916 Anderson ..... E06B 9/52 160/372
1,220,961 A * 3/1917 Darley ..... E06B 11/02 256/73
1,563,602 A * 12/1925 Webster ..... E06B 11/04 256/73
2,804,138 A * 8/1957 Nichols ..... A47H 23/02 160/348
2,975,536 A * 3/1961 Schindler ..... E06B 11/02 256/24
4,057,935 A * 11/1977 Rohrberg ..... E05B 65/1033 292/19
4,356,999 A * 11/1982 McShane ..... B60P 3/00 256/26
4,371,148 A * 2/1983 Harden ..... A01K 1/10 160/135
4,465,262 A * 8/1984 Itri ..... E01F 13/02 160/374
4,702,036 A 10/1987 Johnson
4,884,614 A 12/1989 Spurling
(Continued)

FOREIGN PATENT DOCUMENTS

CA 1271938 A * 7/1990 ..... E06B 9/02
CA 1271938 A 7/1990

*Primary Examiner* — Johnnie A. Shablack

(57) ABSTRACT

The child safety gate system is a modular barricade that forms a barricade in a door selected from a plurality of previously identified doors. The child safety gate system comprises a gate, a plurality of pivot frames and a plurality of latch frames. There is a one to one correspondence between any pivot frame selected from the plurality of pivot frames and a latch frame selected from the plurality of latch frames. Each door contained within the plurality of previously identified doors has installed in it a pivot frame the corresponding latch frame. The selected pivot frame and the corresponding latch frame are used to removably attach the gate to any selected door. This modular behavior allows the installation of the barricade structure in any door selected from the plurality of previously identified doors as required.

10 Claims, 5 Drawing Sheets

(56) References Cited

U.S. PATENT DOCUMENTS 5,100,108 A * 3/1992 Schultz ..... E04H 3/12 256/23
5,116,273 A * 5/1992 Chan ..... A45B 23/00 160/370.21
5,352,149 A * 10/1994 Melashenko ..... A47G 5/00 160/135
D355,261 S 2/1995 Abrams
5,396,732 A * 3/1995 Andersen ..... E06B 9/02 49/255
5,402,988 A * 4/1995 Eisele ..... E01F 13/022 160/351
5,531,258 A * 7/1996 Poulson ..... E06B 9/02 160/371
5,593,141 A * 1/1997 Cain ..... A01K 1/0017 256/26
5,638,885 A * 6/1997 Freese ..... E06B 9/02 160/225
5,657,809 A * 8/1997 Longoria ..... E06B 9/04 160/160
5,716,041 A * 2/1998 Groves ..... E06B 11/02 256/24
5,718,414 A * 2/1998 Deloach ..... E04H 17/163 256/24
5,787,955 A * 8/1998 Dargie ..... E02D 29/12 160/368.1
5,797,218 A * 8/1998 Holland ..... E06B 9/04 49/55
5,878,802 A * 3/1999 Richter ..... A47G 5/00 160/135
6,016,629 A 1/2000 Sylvester
6,209,614 B1 * 4/2001 Smoot ..... A47H 21/00 160/237
6,296,041 B1 * 10/2001 Cicero ..... E06B 9/02 160/327
6,375,165 B1 4/2002 Sherratt
6,446,395 B2 * 9/2002 Rogers ..... E06B 9/04 160/215
6,474,021 B2 * 11/2002 Homeyer ..... A47D 7/002 160/372
6,497,268 B1 * 12/2002 Peppett ..... A47F 5/01 160/374.1
6,591,553 B1 7/2003 Vaughn
6,655,087 B2 * 12/2003 Andersen ..... E06B 9/04 49/55
7,861,764 B1 * 1/2011 Cowan ..... A47F 7/163 160/330
7,913,333 B2 * 3/2011 Flannery ..... A47C 21/08 5/425
8,327,565 B2 * 12/2012 Boltz ..... G09F 15/0025 256/24
8,713,851 B2 * 5/2014 Flannery ..... E06B 9/04 49/55
9,267,323 B2 * 2/2016 Whooley ..... E06B 9/02
9,366,075 B2 * 6/2016 Marsden ..... E06B 9/02
D796,691 S * 9/2017 Marsden ..... E06B 9/02 D25/48.5
9,963,932 B2 * 5/2018 Wang ..... E06B 9/02
9,982,479 B1 * 5/2018 Flannery ..... E06B 9/04
10,024,080 B2 * 7/2018 Marsden ..... E05B 65/0007
10,081,980 B2 * 9/2018 Birkert ..... E06B 9/04
10,267,088 B2 * 4/2019 Marmion ..... E06B 11/02
2006/0180284 A1 * 8/2006 Wiggins ..... E06B 9/02 160/368.1
2007/0131921 A1 * 6/2007 Monahan ..... E06B 9/04 256/73
2008/0110413 A1 5/2008 Kobayashi
2009/0172880 A1 * 7/2009 Wu ..... A47C 21/08 5/425
2014/0007506 A1 * 1/2014 Huang ..... E06B 3/32 49/149
2015/0101250 A1 * 4/2015 Marsden ..... E06B 9/0623 49/55
2017/0350165 A1 * 12/2017 Schort ..... E05B 47/0603
2018/0274288 A1 * 9/2018 Wang ..... E06B 3/921

* cited by examiner

CHILD SAFETY GATE SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings including closures for openings in buildings, more specifically, a safety gate for wall or similar openings.

SUMMARY OF INVENTION

The child safety gate system is a modular barricade system that blocks children from passing through a door selected from a plurality of previously identified doors. The child safety gate system comprises a gate, a plurality of pivot frames and a plurality of latch frames. There is a one to one correspondence between any pivot frame selected from the plurality of pivot frames and a latch frame selected from the plurality of latch frames. Each door contained within the plurality of previously identified doors has installed in it a pivot frame selected from the plurality of pivot frames and the corresponding latch frame selected from the plurality of latch frames. The selected pivot frame and the corresponding latch frame are used to removably attach the gate to any selected door. This modular behavior allows the installation of the barricade structure in any door selected from the plurality of previously identified doors as required.

These together with additional objects, features and advantages of the child safety gate system will be readily apparent to those of ordinary skill in the art upon reading the following detailed description of the presently preferred, but nonetheless illustrative, embodiments when taken in conjunction with the accompanying drawings.

In this respect, before explaining the current embodiments of the child safety gate system in detail, it is to be understood that the child safety gate system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the child safety gate system.

It is therefore important that the claims be regarded as including such equivalent construction insofar as they do not depart from the spirit and scope of the child safety gate system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
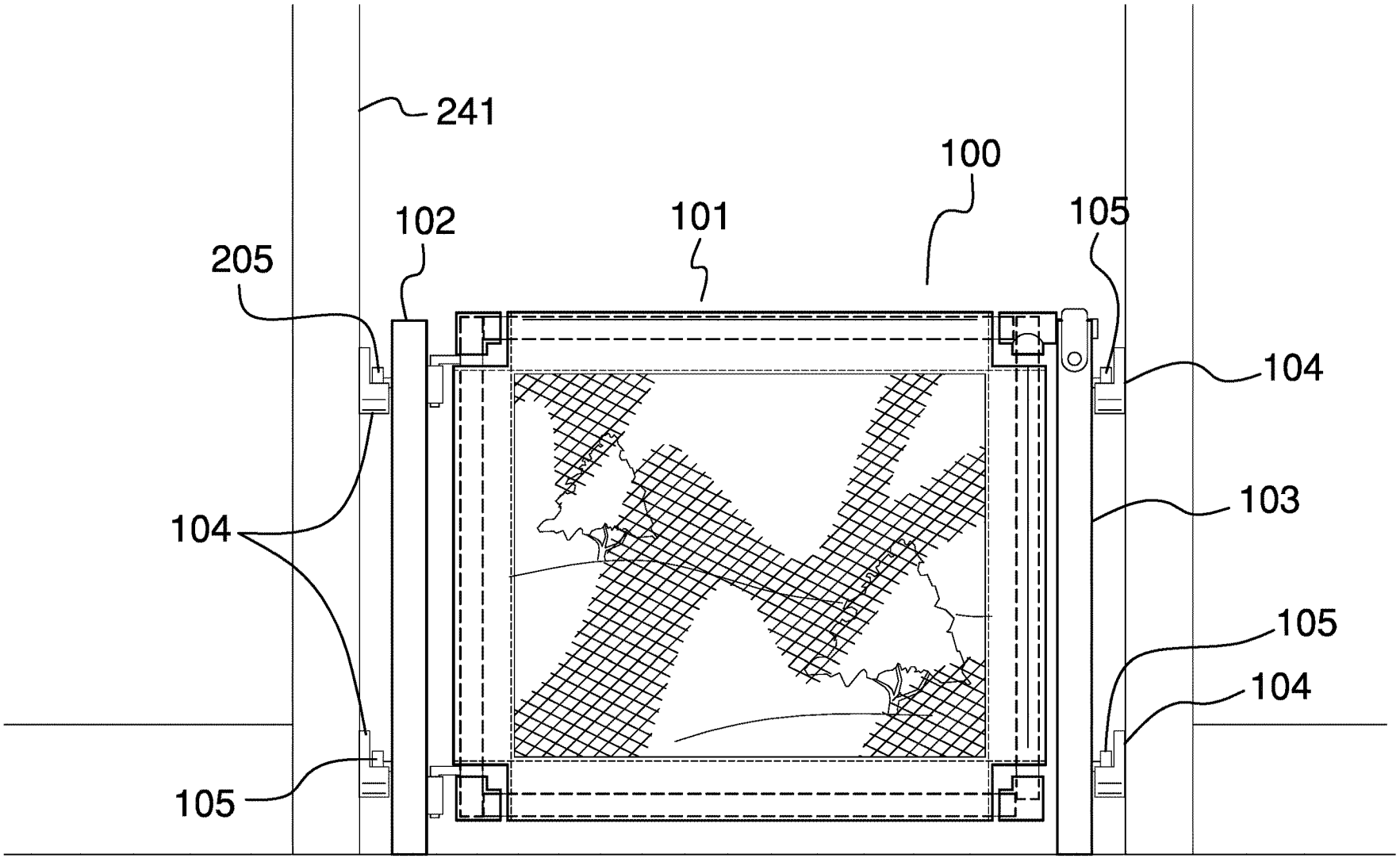
FIG. 1 is a front view of an embodiment of the disclosure.
Figure 2:
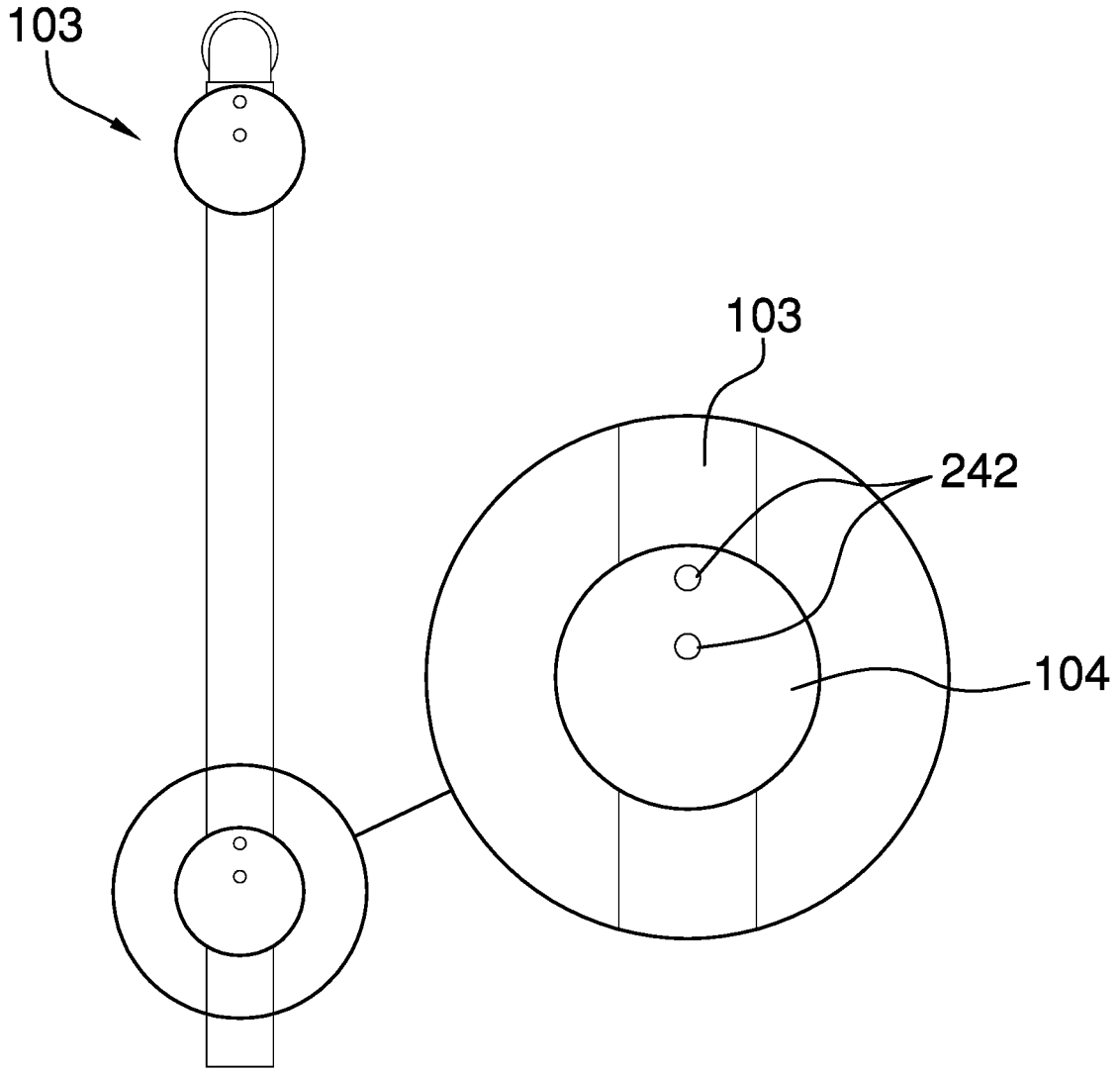
FIG. 2 is a side view of an embodiment of the disclosure.
Figure 3:
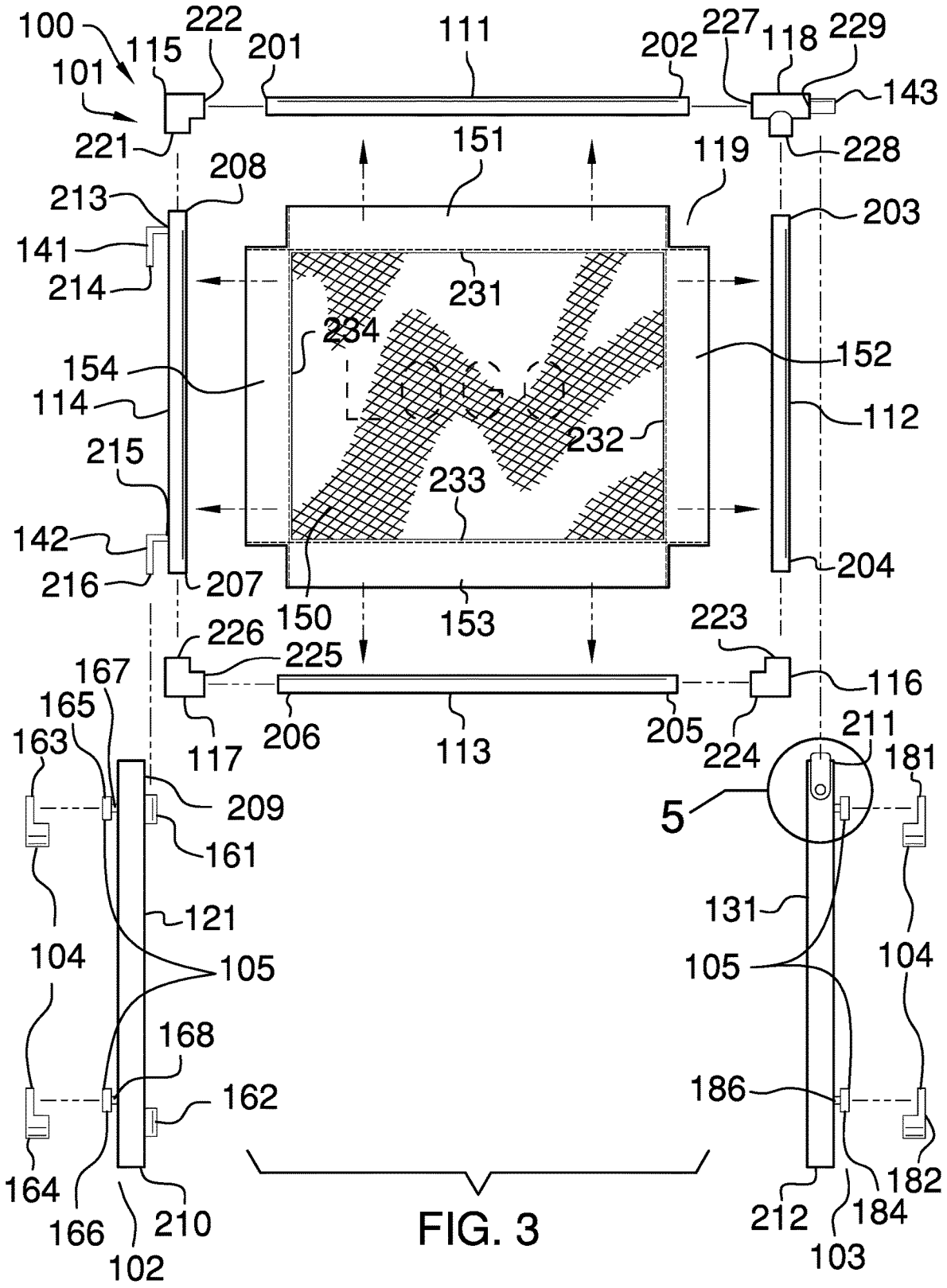
FIG. 3 is an exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The child safety gate system 100 (hereinafter invention) is a modular barricade system that blocks children from passing through a door selected from a plurality of previously identified doors 241. The invention 100 comprises a gate 101, one or more pivot frames 102 and one or more latch frames 103. There is a one to one correspondence between any pivot frame selected from the one or more pivot frames 102 and a latch frame selected from the one or more latch frames 103. Each door contained within the plurality of previously identified doors 241 has installed in it a pivot frame selected from the one or more pivot frames 102 and the corresponding latch frame selected from the one or more latch frames 103. The selected pivot frame and the corresponding selected latch frame are used to removably attach the gate 101 to any selected door.

This modular behavior allows the installation of the barricade structure in any door selected from the plurality of previously identified doors 241 as required. Each door selected from the plurality of previously identified doors 241 is further defined with a first door jamb and a second door jamb.

The gate 101 is a rotating barricade that both prevents and allows passage through a door selected from the plurality of previously identified doors 241. The gate 101 attaches to a pivot frame selected from the one or more pivot frames 102 such that the gate 101 will rotate using the selected pivot frame as the axis of rotation for the gate 101. The gate 101 attaches to a latch frame selected from the one or more latch frames 103 such that the gate 101 is secured to the selected latch frame when the gate 101 is in a closed position.

The gate 101 comprises a first shaft 111, a second shaft 112, a third shaft 113, a fourth shaft 114, a first 90-degree elbow 115, a second 90-degree elbow 116, a third 90-degree elbow 117, a first tee connector 118, and a barrier 119.

The first shaft 111 is further defined with a first end 201 and a second end 202. The second shaft 112 is further defined with a third end 203 and a fourth end 204. The third shaft 113 is further defined with a fifth end 205 and a sixth end 206. The fourth shaft 114 is further defined with a seventh end 207 and an eighth end 208. The first 90-degree elbow 115 is further defined with a first port 221 and a second port 222. The second 90-degree elbow 116 is further defined with a third port 223 and a fourth port 224. The third 90-degree elbow 117 is further defined with a fifth port 225 and a sixth port 226.

The first tee connector 118 is further defined with a seventh port 227, an eighth port 228, and a ninth port 229. The textile 150 is further defined with a first edge 231, a second edge 232, a third edge 233, and a fourth edge 234.

The first shaft 111 is a readily and commercially available cylindrical rod. The second shaft 112 is a readily and commercially available cylindrical rod. The third shaft 113 is a readily and commercially available cylindrical rod. The fourth shaft 114 is a readily and commercially available cylindrical rod. The outer diameters of the first shaft 111, the second shaft 112, the third shaft 113, and the fourth shaft 114 are identical.

The first 90-degree elbow 115 is a readily and commercially available plumbing fitting. The second 90-degree elbow 116 is a readily and commercially available plumbing fitting. The third 90-degree elbow 117 is a readily and commercially available plumbing fitting. The first tee connector 118 is a readily and commercially available plumbing fitting. The inner diameter of each of ports of the first 90-degree elbow 115, the second 90-degree elbow 116, the third 90-degree elbow 117, and the first tee connector 118 are identical.

The outer diameters of the first shaft 111, the second shaft 112, the third shaft 113, and the fourth shaft 114 are lesser than the inner diameter of any port selected from the first 90-degree elbow 115, the second 90-degree elbow 116, the third 90-degree elbow 117, and the first tee connector 118 such that any shaft may be inserted into any port.

The fourth shaft 114 further comprises a first angle pin 141 and a second angle pin 142. The first angle pin 141 is further defined with a thirteenth end 213 and a fourteenth end 214. The second angle pin 142 is further defined with a fifteenth end 215 and a sixteenth end 216. The first angle pin 141 is a readily and commercial cylindrical shaft that is formed with a right angle. The second angle pin 142 is a readily and commercial cylindrical shaft that is formed with a right angle. The first angle pin 141 and the second angle pin 142 are identical.

The first tee connector 118 further comprises a lock extension 143. The lock extension 143 is a readily and commercially available cylindrical rod. The lock extension 143 is sized such that the lock extension 143 can be inserted into the latch channel 171. Specifically, the outer diameter of the lock extension 143 is lesser than the inner diameter of the ninth port 229 of the first tee connector 118 such that the lock extension 143 can be inserted into the ninth port 229.

The first pivot offset shaft 167 is a readily and commercially available cylindrical rod. The first pivot offset shaft 167 is an extension structure that separates the first pivot mount disk 165 from the pivot stanchion 121. The second pivot offset shaft 168 is a readily and commercially available cylindrical rod. The second pivot offset shaft 168 is an extension structure that separates the second pivot mount disk 166 from the pivot stanchion 121.

The barrier 119 is a textile based structure that is suspended from the first shaft 111, the second shaft 112, the third shaft 113, and the fourth shaft 114. The barrier 119 further comprises a textile 150, a first rouleau 151, a second rouleau 152, a third rouleau 153, and a fourth rouleau 154. The textile 150 is a readily and commercially available mesh textile that is cut in a rectangular shape. The textile 150 may be formed with decorative images. The first rouleau 151 is a channel that attaches to the textile 150. The second rouleau 152 is a channel that attaches to the textile 150. The third rouleau 153 is a channel that attaches to the textile 150. The fourth rouleau 154 is a textile based structure that forms a channel that attaches to the textile 150.

The fourth rouleau 154 further comprises a first panel 191, a second panel 192, and a rouleau fastener 193. The rouleau fastener 193 comprises a hook and loop fastener 194. The hook and loop fastener 194 further comprises a first hook/loop surface 195 and a second hook/loop surface 196. The first panel 191 is a readily and commercially available rectangular textile. The second panel 192 is a readily and commercially available rectangular textile. The rouleau fastener 193 is a commercially available fastening device that attaches the first panel 191 to the second panel 192 to form the fourth rouleau 154. In the first potential embodiment of the disclosure, the rouleau fastener 193 is a hook and loop fastener 194. The hook and loop fastener 194, the first hook/loop surface 195, and the second hook/loop surface 196 are described in greater detail elsewhere in this disclosure.

The invention 100 further comprises a plurality of cradles 104

Each of the plurality of cradles 104 is a structure that attaches to the selected door. Each of the plurality of cradles 104 forms an anchor point to which a mounted structure attaches. The mounted structure is selected from the group consisting of a pivot frame selected from the one or more pivot frames 102 and a latch frame selected from the one or more latch frames 103. Each of the plurality of cradles 104 are identical.

Figure 4:
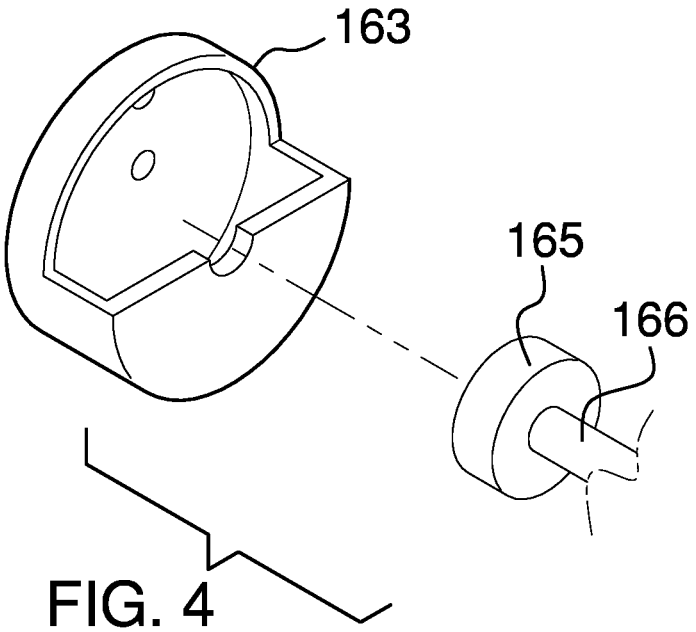
FIG. 4 is a detail view of an embodiment of the disclosure.
Figure 5:
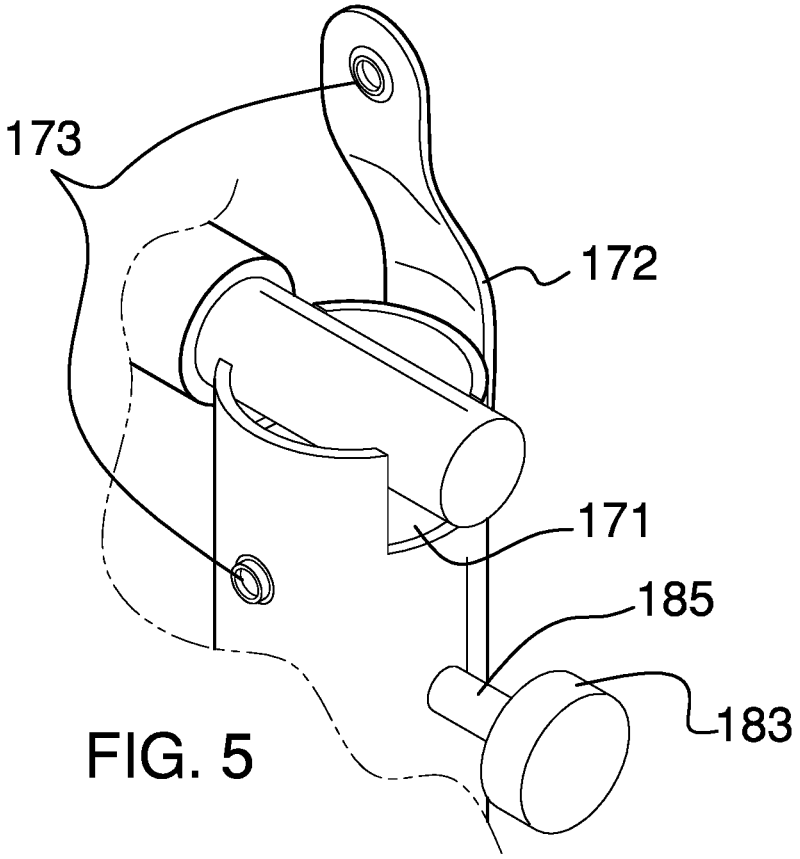
FIG. 5 is a detail view of an embodiment of the disclosure.
Figure 6:
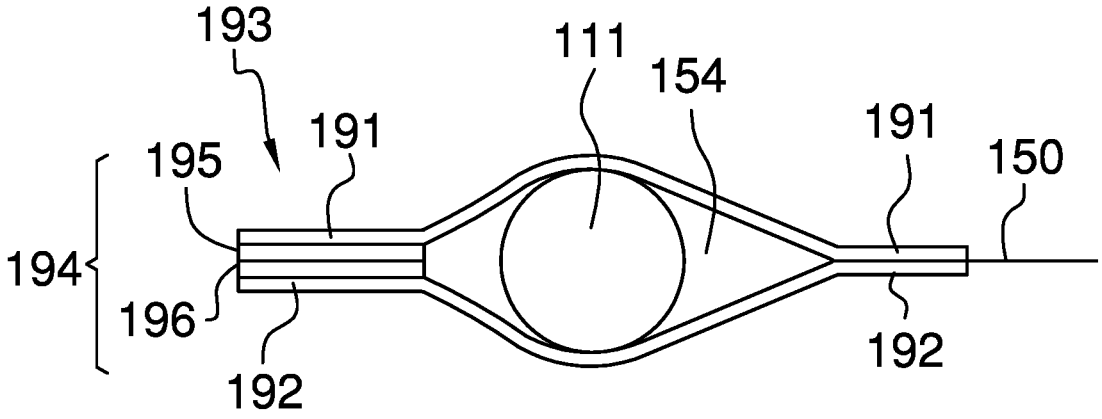
FIG. 6 is a detail view of an embodiment of the disclosure.

As shown most clearly in FIG. 4, each of the plurality of cradles 104 is formed as a hollow cylinder that is further truncated by a partial horizontal segment. The partially truncated horizontal segment is sized such that a mount disk selected from the plurality of mount disks 105 can be inserted into any cradle selected from the plurality of cradles 104. Each of the plurality of cradles 104 further comprises a plurality of apertures 242. The plurality of apertures 242 facilitates screwing each cradle selected from the plurality of cradles 104 into the selected door.

The plurality of cradles 104 comprises a first pivot cradle 163, a second pivot cradle 164, a first latch cradle 181, and a second latch cradle 182.

The invention 100 further comprises a plurality of mount disks 105. Each of the plurality of mount disks 105 is a disk. Each of the plurality of mount disks 105 is inserted into a cradle selected from the plurality of cradles 104 to attach a mounted structure to the to the selected door. Each of the plurality of mount disks 105 is identical.

The plurality of mount disks 105 comprises a first pivot mount disk 165, a second pivot mount disk 166, a first latch mount disk 183, and a second latch mount disk 184.

Each of the one or more pivot frames 102 is a structure that is installed in the selected door. Each of the one or more pivot frames 102 comprises a pivot stanchion 121. Each of the one or more pivot frames 102 is identical.

The pivot stanchion 121 is a vertical support structure that attaches to the selected door. The pivot stanchion 121 further comprises a first pivot barrel 161, a second pivot barrel 162, a first pivot offset shaft 167, and a second pivot offset shaft 168. The pivot stanchion 121 is further defined with a ninth end 209 and a tenth end 210.

The first pivot barrel 161 is a commercially available hollow cylindrical pipe. The inner diameter of the first pivot barrel 161 is greater than the outer diameter of the first angle pin 141. The second pivot barrel 162 is a commercially available hollow cylindrical pipe. The inner diameter of the second pivot barrel 162 is greater than the outer diameter of the second angle pin 142. The first pivot barrel 161 and the second pivot barrel 162 are identical.

The first pivot offset shaft 167 is a readily and commercially available cylindrical rod. The first pivot offset shaft 167 is an extension structure that separates the first pivot mount disk 165 from the pivot stanchion 121. The second pivot offset shaft 168 is a readily and commercially available cylindrical rod. The second pivot offset shaft 168 is an extension structure that separates the second pivot mount disk 166 from the pivot stanchion 121.

Each of the one or more latch frames 103 is a structure that is installed in the selected door. Each of the one or more latch frames 103 comprises a latch stanchion 131. Each of the one or more latch frames 103 is identical.

The latch stanchion 131 is a vertical support structure that attaches to the selected door. The latch stanchion 131 further comprises a first latch offset shaft 185, a second latch offset shaft 186, a latch channel 171, a latch strap 172, and a latch fastener 173. The latch stanchion 131 is further defined with an eleventh end 211 and a twelfth end 212.

The latch channel 171 is a notch that is formed in the eleventh end 211 of the latch stanchion 131. The latch channel 171 is sized such that the lock extension 143 can be inserted into the latch channel 171. As shown most clearly in FIG. 5, the lock extension 143 prevents the gate 101 from rotating when the lock extension 143 is inserted into the latch channel 171.

The latch strap 172 is a textile strap that attaches to the latch stanchion 131. The latch strap 172 is positioned such that the latch strap 172 can be placed and secured directly over the eleventh end 211 of the latch stanchion 131. The latch fastener 173 secures the latch strap 172 to the latch stanchion 131 such that the lock extension 143 is contained within the latch channel 171. In the first potential embodiment of the disclosure, the latch fastener 173 is a snap.

The first latch offset shaft 185 is a readily and commercially available cylindrical rod. The first latch offset shaft 185 is an extension structure that separates the first latch mount disk 183 from the latch stanchion 131. The second latch offset shaft 186 is a readily and commercially available cylindrical rod. The second latch offset shaft 186 is an extension structure that separates the second latch mount disk 184 from the latch stanchion 131.

The assembly of the gate 101 is described in the following five paragraphs.

The first rouleau 151 attaches to the first edge 231 of the textile 150. The second rouleau 152 attaches to the second edge 232 of the textile 150. The third rouleau 153 attaches to the third edge 233 of the textile 150. The fourth rouleau 154 attaches to the fourth edge 234 of the textile 150. The first shaft 111 inserts through the first rouleau 151. The second shaft 112 inserts through the second rouleau 152. The third shaft 113 inserts through the third rouleau 153.

The first end 201 of the first shaft 111 inserts into the second port 222 of the first 90-degree elbow 115. The second end 202 of the first shaft 111 inserts into the seventh port 227 of the first tee connector 118. The lock extension 143 of the first tee connector 118 inserts into the ninth port 229 of the first tee connector 118. The third end 203 of the second shaft 112 inserts into the eighth port 228 of the first tee connector 118. The fourth end 204 of the second shaft 112 inserts into the third port 223 of the second 90-degree elbow 116. The fifth end 205 of the third shaft 113 inserts into the fourth port 224 of the second 90-degree elbow 116. The sixth end 206 of the third shaft 113 inserts into the fifth port 225 of the third 90-degree elbow 117. The seventh end 207 of the fourth shaft 114 inserts into the sixth port 226 of the third 90-degree elbow 117. The eighth end 208 of the fourth shaft 114 inserts into the first port 221 of the first 90-degree elbow 115.

The thirteenth end 213 of the first angle pin 141 attaches to the face of the fourth shaft 114 such that: 1) fourteenth end 214 of the first angle pin 141 points towards the seventh end 207 of the fourth shaft 114; and, 2) the first angle pin 141 projects perpendicularly away from the face of the fourth shaft 114. The fifteenth end 215 of the second angle pin 142 attaches to the face of the fourth shaft 114 such that: 1) sixteenth end 216 of the second angle pin 142 points towards the seventh end 207 of the fourth shaft 114; and, 2) the second angle pin 142 projects perpendicularly away from the face of the fourth shaft 114.

To secure the fourth rouleau 154 to the fourth shaft 114, the first panel 191 of the fourth rouleau 154 and the second panel 192 of the fourth rouleau 154 both wrap around the fourth shaft 114. The first panel 191 and the second panel 192 are secured to the fourth rouleau 154 using the rouleau fastener 193. In the first potential embodiment of the disclosure, the first hook/loop surface 195 is pressed into the second hook/loop surface 196 to secure the hook and loop fastener 194 to the fourth shaft 114. The first hook/loop surface 195 attaches to the first panel 191 using an adhesive seam. The second hook/loop surface 196 attaches to the second panel 192 using an adhesive seam.

The assembly of a pivot frame selected from the one or more pivot frames 102 is described in the following five paragraphs.

To attach the pivot stanchion 121 to a door selected from the plurality of previously identified doors 241, the first pivot cradle 163 attaches to the first door jamb. The second pivot cradle 164 attaches to the first door jamb in an inferior position to the first pivot cradle 163.

The first pivot offset shaft 167 attaches to the pivot stanchion 121 in the manner of a cantilever. The first pivot offset shaft 167 projects perpendicularly away from the face of the pivot stanchion 121. The second pivot offset shaft 168 attaches to the pivot stanchion 121 in the manner of a cantilever. The second pivot offset shaft 168 projects perpendicularly away from the face of the pivot stanchion 121. The second pivot offset shaft 168 is located in an inferior position relative to the position of the first pivot offset shaft 167. The first pivot mount disk 165 attaches to the free end of the first pivot offset shaft 167. The second pivot mount disk 166 attaches to the free end of the second pivot offset shaft 168.

The first pivot barrel 161 attaches to the free end of the pivot stanchion 121 such that the center axis of the first pivot barrel 161 is parallel to the center axis of the pivot stanchion 121. The first pivot barrel 161 is located on the face of the pivot stanchion 121 in a position that is distal from the first pivot offset shaft 167. The second pivot barrel 162 attaches to the free end of the pivot stanchion 121 such that the center axis of the second pivot barrel 162 is parallel to the center axis of the pivot stanchion 121. The second pivot barrel 162 is located on the face of the pivot stanchion 121 in a position that is distal from the second pivot offset shaft 168.

The pivot stanchion 121 attaches to the first door jamb by simultaneously inserting: 1) the first pivot mount disk 165 into the first pivot cradle 163; and, 2) the second pivot mount disk 166 into the second pivot cradle 164; while, 3) the tenth end 210 of the pivot stanchion 121 is in an inferior position relative to the ninth end 209 of the pivot stanchion 121.

To attach the gate 101 to the pivot stanchion 121, the fourteenth end 214 of the first angle pin 141 inserts into the first pivot barrel 161 and the sixteenth end 216 of the second angle pin 142 is inserted into the second pivot barrel 162.

The assembly of a latch frame selected from the one or more latch frames 103 is described in the following four paragraphs.

To attach the latch stanchion 131 to a door selected from the plurality of previously identified doors 241, the first latch cradle 181 attaches to the second door jamb. The second latch cradle 182 attaches to the first door jamb in an inferior position to the first latch cradle 181.

The first latch offset shaft 185 attaches to the latch stanchion 131 in the manner of a cantilever. The first latch offset shaft 185 projects perpendicularly away from the face of the latch stanchion 131. The second latch offset shaft 186 attaches to the latch stanchion 131 in the manner of a cantilever. The second latch offset shaft 186 projects perpendicularly away from the face of the latch stanchion 131. The second latch offset shaft 186 is located in an inferior position relative to the position of the first latch offset shaft 185. The first latch mount disk 183 attaches to the free end of the first latch offset shaft 185. The second latch mount disk 184 attaches to the free end of the second latch offset shaft 186.

The latch stanchion 131 attaches to the second door jamb by simultaneously inserting: 1) the first latch mount disk 183 into the first latch cradle 181; and, 2) the second latch mount disk 184 into the second latch cradle 182; while, 3) the twelfth end 212 of the latch stanchion 131 is in an inferior position relative to the eleventh end 211 of the latch stanchion 131.

The latch channel 171 is formed in the eleventh end 211 of the latch stanchion 131. The latch strap 172 and the latch fastener 173 attach to the eleventh end 211 of the latch stanchion 131 such that the latch strap 172 will enclose the lock extension 143 within the latch channel 171.

The following definitions were used in this disclosure:

90-Degree Elbow: As used in this disclosure, a 90-degree elbow is a two aperture fitting that attaches a first pipe to a second pipe such that the center axis of the first pipe is perpendicular to the center axis of the second pipe.

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Anchor: As used in this disclosure, anchor means to hold an object firmly or securely.

Anchor Point: As used in this disclosure, an anchor point is a location to which a first object can be securely attached to a second object.

Barrel: As used in this disclosure, a barrel is a cylindrical, or roughly cylindrical, structure that is intended to contain an object.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinders, prisms or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Correspond: As used in this disclosure, the term correspond means that a first object is in some manner linked to a second object in a one to one relationship.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Disk: As used in this disclosure, a disk is a cylindrically shaped object that is flat in appearance.

Extension Structure: As used in this disclosure, an extension structure is an inert physical structure that is used to extend the span of the distance between any two objects.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Hinge: As used in this disclosure, a hinge is a device that permits the turning, rotating, or pivoting of a first object relative to a second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts as a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface. Horizontal Segment: As used in this disclosure, a horizontal segment refers to a prism or cylinder that is truncated by a single plane that is parallel to or contains the center axis of the prism or cylinder.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Notch: As used in this disclosure, a notch is: 1) an indentation formed in an edge; or 2) a cavity or aperture formed within a surface.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Pivot: As used in this disclosure, a pivot is a rod or shaft around which an object rotates or swings.

Outer Diameter: As used in this disclosure, the term outer diameter is used in the same way that a plumber would refer to the outer diameter of a pipe.

Rouleau: As used in this disclosure, a rouleau is a tube or channel that is formed on the edge of a textile.

Screw: When used as a verb in this disclosure, to screw means: 1) to fasten or unfasten (unscrew) a threaded connection; or 2) to attach a helical structure to a solid structure.

Screw: As used in this disclosure, a screw is a cylindrical, or tapered cylindrical, structure that is formed with an exterior screw thread. A screw is used to attach a first object to a second object. Screws are well known and documented in the mechanical arts.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Snap: As used in this disclosure, a snap is a fastener that comprises a male component and a female component. The snap is engaged by pressing the male component into the female component.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity.

Tee Connector: As used in this disclosure, a T Connector is a three aperture fitting that is designed to connect a first pipe, a second pipe and a third pipe such that: 1) the center axis of the first pipe is aligned with the center axis of the second pipe; 2) the center axis of the third pipe is perpendicular to the aligned center axes of the first pipe and the second pipe; and, 3) the center axes of the first pipe, the second pipe, and the third pipe intersect at a single point. The tee connector is a commercially available plumbing and PVC pipe fitting.

Textile: As used in this disclosure, a textile is a material that is woven, knitted, braided or felted. Synonyms in common usage for this definition include fabric and cloth.

Truncated: As used in this disclosure, a geometric object is truncated when an apex, vertex, or end is cut off by a line or plane.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modular barricade comprising:

a gate, one or more pivot frames, and one or more latch frames;

wherein there is a one to one correspondence between any pivot frame selected from the one or more pivot frames and a latch frame selected from the one or more latch frames;

wherein the selected pivot frame and the corresponding selected latch frame removably attach the gate to a door;

wherein the modular barricade controls access through the door;

wherein the door is further defined with a first door jamb and a second door jamb;

wherein the door has installed in it a pivot frame selected from the one or more pivot frames and the corresponding latch frame selected from the one or more latch frames;

wherein the gate attaches to the pivot frame selected from the one or more pivot frames such that the gate will rotate using the selected pivot frame as the axis of rotation for the gate;

wherein the gate attaches to the latch frame selected from the one or more latch frames such that the gate is secured to the selected latch frame when the gate is in a closed position;

wherein the gate comprises a first shaft, a second shaft, a third shaft, a fourth shaft, a first 90-degree elbow, a second 90-degree elbow, a third 90-degree elbow, a first tee connector, and a barrier;

wherein the first shaft, the second shaft, the third shaft, the fourth shaft, the first 90-degree elbow, the second 90-degree elbow, the third 90-degree elbow, and the first tee connector are interconnected;

wherein the barrier is an interconnected structure formed from the first shaft, the second shaft, the third shaft, the fourth shaft, the first 90-degree elbow, the second 90-degree elbow, the third 90-degree elbow, and the first tee connector;

wherein the first shaft is further defined with a first end and a second end;

wherein the second shaft is further defined with a third end and a fourth end;

wherein the third shaft is further defined with a fifth end and a sixth end;

wherein the fourth shaft is further defined with a seventh end and an eighth end;

wherein the first 90-degree elbow is further defined with a first port and a second port;

wherein the second 90-degree elbow is further defined with a third port and a fourth port;

wherein the third 90-degree elbow is further defined with a fifth port and a sixth port;

wherein the first tee connector is further defined with a seventh port, an eighth port, and a ninth port;

wherein a textile is further defined with a first edge, a second edge, a third edge, and a fourth edge;

wherein the first shaft is a cylindrical rod;

wherein the second shaft is a cylindrical rod;

wherein the third shaft is a cylindrical rod;

wherein the fourth shaft is a cylindrical rod;

wherein the outer diameters of the first shaft, the second shaft, the third shaft, and the fourth shaft are identical;

wherein the first 90-degree elbow is a plumbing fitting;

wherein the second 90-degree elbow is a plumbing fitting;

wherein the third 90-degree elbow is a plumbing fitting;

wherein the first tee connector is a plumbing fitting;

wherein the inner diameter of each of ports of the first 90-degree elbow, the second 90-degree elbow, the third 90-degree elbow, and the first tee connector are identical;

wherein the outer diameters of the first shaft, the second shaft, the third shaft, and the fourth shaft are lesser than the inner diameter of any port selected from the first 90-degree elbow, the second 90-degree elbow, the third 90-degree elbow, and the first tee connector;

wherein the fourth shaft further comprises a first angle pin and a second angle pin;

wherein the first angle pin is a cylindrical shaft that is formed with a right angle;

wherein the second angle pin is a cylindrical shaft that is formed with a right angle;

wherein the first angle pin and the second angle pin are identical;

wherein the first angle pin is further defined with a thirteenth end and a fourteenth end;

wherein the second angle pin is further defined with a fifteenth end and a sixteenth end;

wherein the textile is a mesh textile cut in a rectangular shape;

wherein the barrier further comprises the textile, a first rouleau, a second rouleau, a third rouleau, and a fourth rouleau;

wherein the first rouleau is a channel that attaches to the textile;

wherein the second rouleau is a channel that attaches to the textile;

wherein the third rouleau is a channel that attaches to the textile;

wherein the fourth rouleau is a textile based structure that forms a channel that attaches to the textile;

wherein the fourth rouleau further comprises a first panel, a second panel, and a rouleau fastener;

wherein the first panel is a rectangular textile;

wherein the second panel is a rectangular textile;

wherein the rouleau fastener is a fastening device that attaches the first panel to the second panel to form the fourth rouleau;

wherein the modular barricade further comprises a plurality of cradles each of the plurality of cradles attaches to the door;

wherein each of the plurality of cradles forms an anchor point to which a mounted structure attaches;

wherein the mounted structure is selected from the group consisting of the pivot frame selected from the one or more pivot frames and the latch frame selected from the one or more latch frames;

wherein each of the plurality of cradles are identical;

wherein each of the plurality of cradles is formed as a hollow cylinder that is truncated by a partial horizontal segment;

wherein the modular barricade further comprises a plurality of mount disks;

wherein each of the plurality of mount disks is a disk;

wherein the partially truncated horizontal segment of each of the plurality of cradles is sized such that a mount disk selected from the plurality of mount disks inserts into any cradle selected from the plurality of cradles;

wherein each of the plurality of mount disks is inserted into a cradle selected from the plurality of cradles;

wherein each of the plurality of mount disks is identical;

wherein each of the one or more pivot frames comprises a pivot stanchion;

wherein each of the one or more pivot frames is identical;

wherein the pivot stanchion is a vertical support structure that attaches to the door;

wherein the pivot stanchion further comprises a first pivot barrel, a second pivot barrel, a first pivot offset shaft, and a second pivot offset shaft;

wherein the first pivot barrel, the second pivot barrel, the first pivot offset shaft, and the second pivot offset shaft attach to the vertical support structure of the pivot stanchion;

wherein the pivot stanchion is further defined with a ninth end and a tenth end.

2. The modular barricade according to claim 1 wherein the first pivot barrel is a hollow cylindrical pipe;

wherein the inner diameter of the first pivot barrel is greater than the outer diameter of the first angle pin;

wherein the second pivot barrel is a hollow cylindrical pipe;

wherein the inner diameter of the second pivot barrel is greater than the outer diameter of the second angle pin;

wherein the first pivot barrel and the second pivot barrel are identical.

3. The modular barricade according to claim 2 wherein the first pivot offset shaft is a cylindrical rod;

wherein the first pivot offset shaft is an extension structure that separates a first pivot mount disk from the pivot stanchion;

wherein the second pivot offset shaft is a cylindrical rod;

wherein the second pivot offset shaft is an extension structure that separates a second pivot mount disk from the pivot stanchion.

4. The modular barricade according to claim 3 wherein each of the one or more latch frames is further defined with a latch stanchion;

wherein each of the one or more latch frames is identical;

wherein the latch stanchion is a vertical support structure that attaches to the door;

wherein the latch stanchion further comprises a first latch offset shaft, a second latch offset shaft, a latch channel, a latch strap, and a latch fastener;

wherein the first latch offset shaft, the second latch offset shaft, the latch channel, the latch strap, and the latch fastener attach to the vertical support structure of the latch stanchion;

wherein the latch stanchion is further defined with an eleventh end and a twelfth end.

5. The modular barricade according to claim 4 wherein the latch channel is a notch that is formed in the eleventh end of the latch stanchion;

wherein the latch channel is sized such that a lock extension inserts into the latch channel;

wherein the latch strap is a textile strap that attaches to the latch stanchion;

wherein the latch strap is positioned such that the latch strap is placed and secured directly over the eleventh end of the latch stanchion;

wherein the latch fastener secures the latch strap to the latch stanchion such that the lock extension is contained within the latch channel;

wherein the first tee connector further comprises the lock extension;

wherein the lock extension is a cylindrical rod;

wherein the lock extension is sized such that the lock extension inserts into the latch channel;

wherein the outer diameter of the lock extension is lesser than the inner diameter of the ninth port of the first tee connector such that the lock extension inserts into the ninth port.

6. The modular barricade according to claim 5 wherein the first latch offset shaft is a cylindrical rod;

wherein the first latch offset shaft is an extension structure that separates the first latch mount disk from the latch stanchion;

wherein the second latch offset shaft is a cylindrical rod;

wherein the second latch offset shaft is an extension structure that separates the second latch mount disk from the latch stanchion.

7. The modular barricade according to claim 6 wherein the first rouleau attaches to the first edge of the textile;

wherein the second rouleau attaches to the second edge of the textile;

wherein the third rouleau attaches to the third edge of the textile;

wherein the fourth rouleau attaches to the fourth edge of the textile;

wherein the first shaft inserts through the first rouleau;

wherein the second shaft inserts through the second rouleau;

wherein the third shaft inserts through the third rouleau;

wherein the first end of the first shaft inserts into the second port of the first 90-degree elbow;

wherein the second end of the first shaft inserts into the seventh port of the first tee connector;

wherein the lock extension of the first tee connector inserts into the ninth port of the first tee connector;

wherein the third end of the second shaft inserts into the eighth port of the first tee connector;

wherein the fourth end of the second shaft inserts into the third port of the second 90-degree elbow;

wherein the fifth end of the third shaft inserts into the fourth port of the second 90-degree elbow;

wherein the sixth end of the third shaft inserts into the fifth port of the third 90-degree elbow;

wherein the seventh end of the fourth shaft inserts into the sixth port of the third 90-degree elbow;

wherein the eighth end of the fourth shaft inserts into the first port of the first 90-degree elbow;

wherein the thirteenth end of the first angle pin attaches to the face of the fourth shaft such that the fourteenth end of the first angle pin points towards the seventh end of the fourth shaft;

wherein the thirteenth end of the first angle pin attaches to the face of the fourth shaft such that the first angle pin projects perpendicularly away from the face of the fourth shaft;

wherein the fifteenth end of the second angle pin attaches to the face of the fourth shaft such that the sixteenth end of the second angle pin points towards the seventh end of the fourth shaft;

wherein the fifteenth end of the second angle pin attaches to the face of the fourth shaft such that the second angle pin projects perpendicularly away from the face of the fourth shaft;

wherein to secure the fourth rouleau to the fourth shaft, the first panel of the fourth rouleau and the second panel of the fourth rouleau both wrap around the fourth shaft;

wherein the first panel and the second panel are secured to the fourth rouleau using the rouleau fastener.

8. The modular barricade according to claim 7 wherein the plurality of cradles comprises a first pivot cradle, a second pivot cradle;

wherein the plurality of mount disks comprises a first pivot mount disk and a second pivot mount disk;

wherein the first pivot cradle attaches to the first door jamb;

wherein the second pivot cradle attaches to the first door jamb in an inferior position to the first pivot cradle;

wherein the first pivot offset shaft attaches to the pivot stanchion in the manner of a cantilever;

wherein the first pivot offset shaft projects perpendicularly away from the face of the pivot stanchion;

wherein the second pivot offset shaft attaches to the pivot stanchion in the manner of a cantilever;

wherein the second pivot offset shaft projects perpendicularly away from the face of the pivot stanchion;

wherein the second pivot offset shaft is located in an inferior position relative to the position of the first pivot offset shaft;

wherein the first pivot mount disk attaches to the free end of the first pivot offset shaft;

wherein the second pivot mount disk attaches to the free end of the second pivot offset shaft;

wherein the first pivot barrel attaches to the free end of the pivot stanchion such that the center axis of the first pivot barrel is parallel to the center axis of the pivot stanchion;

wherein the first pivot barrel is located on the face of the pivot stanchion in a position that is distal from the first pivot offset shaft;

wherein the second pivot barrel attaches to the free end of the pivot stanchion such that the center axis of the second pivot barrel is parallel to the center axis of the pivot stanchion;

wherein the second pivot barrel is located on the face of the pivot stanchion in a position that is distal from the second pivot offset shaft;

wherein the first pivot mount disk inserts into the first pivot cradle;

wherein the second pivot mount disk inserts into the second pivot cradle wherein the tenth end of the pivot stanchion is in an inferior position relative to the ninth end of the pivot stanchion.

9. The modular barricade according to claim 8 wherein the plurality of cradles comprises a first latch cradle, a second latch cradle;

wherein the plurality of mount disks comprises a first latch mount disk, and a second latch mount disk;

wherein the first latch cradle attaches to the second door jamb;

wherein the second latch cradle attaches to the first door jamb in an inferior position to the first latch cradle;

wherein the first latch offset shaft attaches to the latch stanchion in the manner of a cantilever;

wherein the first latch offset shaft projects perpendicularly away from the face of the latch stanchion;

wherein the second latch offset shaft attaches to the latch stanchion in the manner of a cantilever;

wherein the second latch offset shaft projects perpendicularly away from the face of the latch stanchion;

wherein the second latch offset shaft is located in an inferior position relative to the position of the first latch offset shaft;

wherein the first latch mount disk attaches to the free end of the first latch offset shaft;

wherein the second latch mount disk attaches to the free end of the second latch offset shaft;

wherein the first latch mount disk inserts into the first latch cradle;

wherein the second latch mount disk inserts into the second latch cradle; while, wherein the twelfth end of the latch stanchion is in an inferior position relative to the eleventh end of the latch stanchion;

wherein the latch channel is formed in the eleventh end of the latch stanchion;

wherein the latch strap and the latch fastener attach to the eleventh end of the latch stanchion such that the latch strap will enclose the lock extension within the latch channel.

10. The modular barricade according to claim 9 wherein the rouleau fastener comprises a hook and loop fastener;

wherein the hook and loop fastener further comprises a first hook and loop surface and a second hook and loop surface;

wherein the latch fastener is a snap;

wherein the first hook and loop surface attaches to the first panel using an adhesive seam;

wherein the second hook and loop surface attaches to the second panel using an adhesive seam;

wherein the first hook and loop surface is pressed into the second hook and loop surface to secure the hook and loop fastener to the fourth shaft.

* * * * *